United States Patent [19]

Ferrante

[11] 4,139,124

[45] Feb. 13, 1979

[54] LIQUID DISPENSING CONTAINER

[76] Inventor: Jose Ferrante, 9 de Julio 1025, Bernal, Argentina

[21] Appl. No.: 796,351

[22] Filed: May 12, 1977

[30] Foreign Application Priority Data

May 17, 1976 [AR] Argentina ..... 263305

[51] Int. Cl.[2] ..... B67D 1/16

[52] U.S. Cl. ..... 222/110; 222/213; 222/494

[58] Field of Search ..... 222/109–111, 222/206, 209, 213, 400.5, 401, 494, 491, 498, 571

[56] References Cited

U.S. PATENT DOCUMENTS

| | | | |
|---|---|---|---|
| 1,668,895 | 5/1928 | Fulton | 222/213 |
| 1,908,584 | 5/1933 | Weirich | 222/491 |
| 1,977,227 | 10/1934 | Berendt | 222/494 |
| 2,459,215 | 1/1949 | Blake et al. | 222/110 |
| 2,598,869 | 6/1952 | White | 222/401 |
| 4,020,978 | 5/1977 | Szczepanski | 222/209 |

FOREIGN PATENT DOCUMENTS

| | | | |
|---|---|---|---|
| 560545 | 4/1944 | United Kingdom | 222/494 |

*Primary Examiner*—Stanley H. Tollberg
*Assistant Examiner*—H. Grant Skaggs
*Attorney, Agent, or Firm*—Emory L. Groff, Jr.

[57] ABSTRACT

A liquid dispensing container is provided with a pressure controlled flexible outlet which is opened and closed by applying and releasing pressure on a flexible area in the cover of the container above the level of the liquid and opposite the flexible outlet of the cover. An increase of pressure within the container by pressure on the flexible area causes automatic opening of a resilient conduit in the outlet permitting liquid to pass therethrough while a decrease of pressure in the container causes the resilient conduit to close and seal the container. A collection spout surrounds the resilient conduit and any dripping of liquid occurring when the contents of the container are being dispensed is collected in the spout and forced back into the container through a valve controlled orifice when pressure on the flexible area of the container is released.

8 Claims, 15 Drawing Figures

SECTION A-A

SECTION B-B

LIQUID DISPENSING CONTAINER

The present invention refers to improvements in liquid dispensing containers by means of which important advantages in application and use for the purpose specified are obtained.

The difficulties inherent to product dispensers for liquids are well known. In many cases, the use of such dispensers requires the use of both hands and the removal and later covering of the container after use becomes part of the operation. Furthermore, the stream of liquid is difficult to regulate inasmuch as it varies not only due to the angle of inclination at which the receptacle is held, but also due to the volume or quantity of liquid contained therein, which determines its piezometric height. One of the most frequent problems is the drip from the outlet nozzle which stains the surface on which the receptacle is resting. Where oil or vinegar is concerned, the drops can stain the clothes of the diners, to their consequent annoyance and that of the operator. If the receptacle is accidently tipped over it generally happens that part of the liquid is spilled due to the fact that the plugs used in this type of dispenser are frequently merely applied to the receptacle but not tightened thereon. Mention can also be made of oil containers the top face of which has a permanent uncovered orifice, through which insects or dust from the ambient medium may gain entry.

In order to overcome these difficulties the present invention provides an oil, vinegar or other liquid dispenser the use of which requires merely one hand. The stream of liquid can be regulated at will and the dispensing receptacle is hermetic and opens and closes automatically when being used. Thus, if the container is accidentally tipped over, the liquid will not be spilled. Also, a series of small devices eliminates the dripping that usually is to be expected with containers of this kind.

The liquid dispensing container which is the object of the present invention is characterized in that it consists essentially of a hollow body capable of storing the liquid to be dispensed. The body is provided with an orifice capable of being closed by means of a threaded plug or any other commonly-used means; or said body can consist of two or more parts joined by means of threads or any other separable joining means. A resilient region of said hollow body can be deformed by the operator by forcing said resilient region into the inner volume of the main hollow body. This resilient region can be a piece which is integrally joined to said hollow body, its cross-section being cylindrical or polygonal, its faces smooth or folded like a bellows; or it may also be a cylindrical member or piston sliding within another cylindrical body. The resilient condition which enables the resilient region to always return to its original position is due to the characteristics of the material of which it is formed, i.e., that it has a resilient memory, or has an auxiliary spring affixed thereto.

All the above variations have as their main object to reduce, by deformation, the inner volume of the hollow body, thus bringing about an increase in the internal pressure, which increase will be a function of the pressure exerted on the resilient region by the user. Thus, the amount of liquid dispensed from within the hollow body, is determined by the amount of pressure exerted by the user on said resilient region. The increased pressure within the container causes the resilient conduit which acts as a valve. This opening of the outlet orifice formed by a resilient conduit is joined integrally at one of its ends to the outlet orifice of the hollow body, being hermetically joined thereto over its entire perimeter. The resilient conduit is capable of being resiliently deformed proportionately to the internal pressure within the hollow body and it is therefore possible to regulate at will the free end of the outlet section of the valve or resilient conduit, by merely increasing or diminishing the pressure acting on the deformable resilient region.

The resilient conduit may have a cylindrical, conical or polygonal cross-section. The resiliency of the walls of this conduit is assured by the resilient memory of the material of which it is made, or by additional resilient elements which force the walls of said conduit to close on themselves, thus obstructing the passage of liquid when the internal pressure disappears. It is to be pointed out that the liquid can only be expelled when the dosifier is placed in the proper position, namely, with the outlet orifice pointing downwards. No liquid can be expelled when the dosifier is in vertical or resting position. The resilient conduit is covered partially or totally by a collecting nozzle of convenient length, the object of which is to retain and store the liquid which normally drips when the liquid stream is cut off. The collecting nozzle is disposed in front of an orifice which is closed from inside the hollow body by a resilient valve situated below the outlet orifice, in such a manner that the vacuum produced inside the hollow body by the return to the original position of the resilient region when the operator relieves the pressure applied thereto, brings about a violet ingress of air through the orifice in question, not through the resilient outlet conduit. This air stream, overcoming the tension of the resilient valve, will carry into the hollow body the liquid that has accumulated around the base of the collecting nozzle, the closure of the orifice being effected by the valve once the pressures have been equalized. It must be pointed out that the resilient nozzle will close automatically when the operator withdraws the pressure applied to the deformable resilient region, due to the combined effect of the reduction of pressure inside the hollow body and the action of the resilient elements which return to their original position.

In order that the present invention may be clearly understood and readily put into practice, illustrative but not limitative examples of same will now be described with reference to the accompanying drawings.

In the drawings.

Similar reference characters designate similar parts throughout the figures of the drawings.

Figure 1:
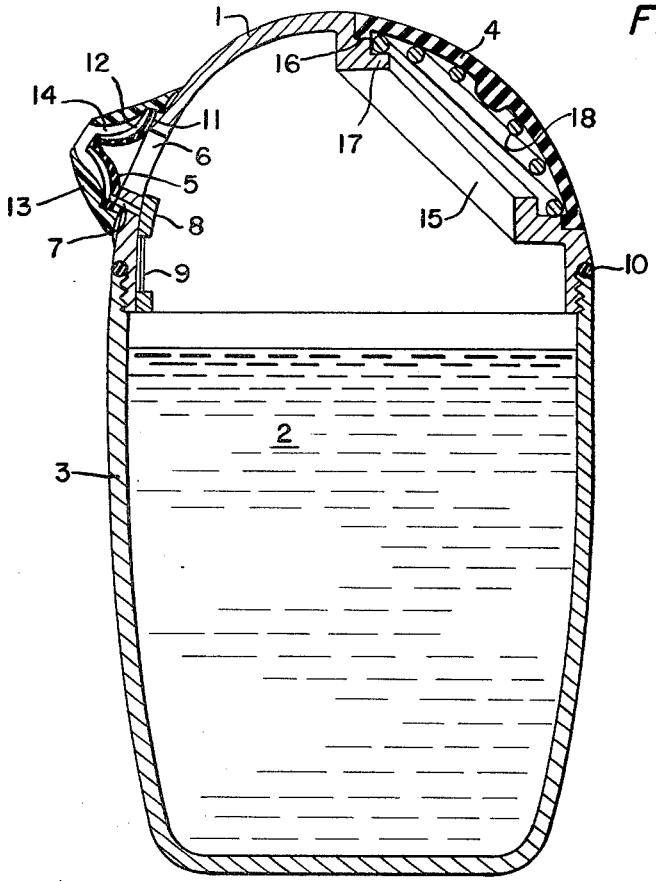
FIG. 1 is a vertical section of the liquid dispensing container of the present invention.
Figure 2:
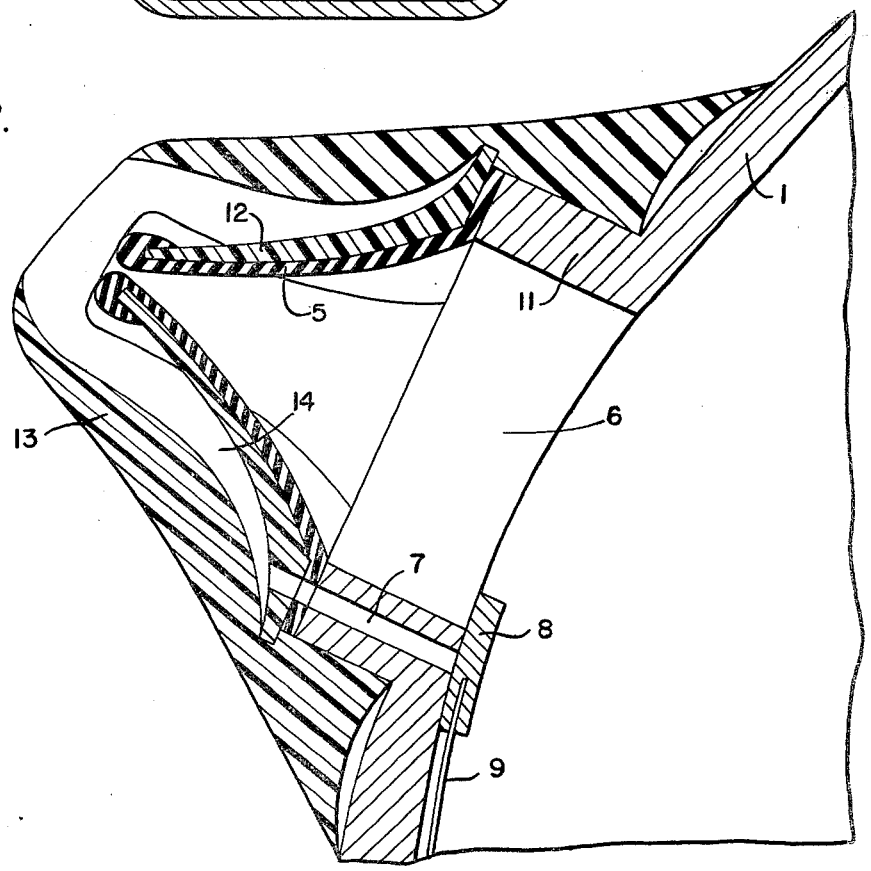
FIG. 2 is an enlarged fragmentary section of the resilient outlet conduit, collector nozzle and collecting valve.
Figure 3:
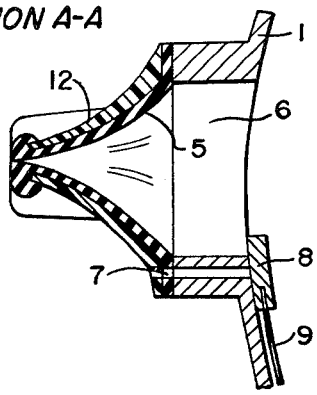
FIG. 3 is a fragmentary section on the line A—A of FIG. 4 showing the resilient outlet conduit in a closed position.
Figure 4:
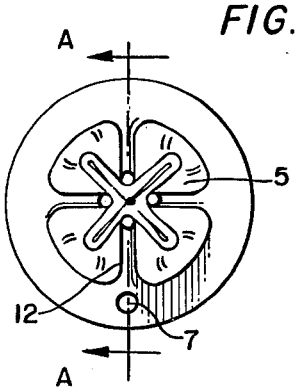
FIG. 4 is a front elevation of the resilient outlet conduit shown in FIG. 3.
Figure 5:
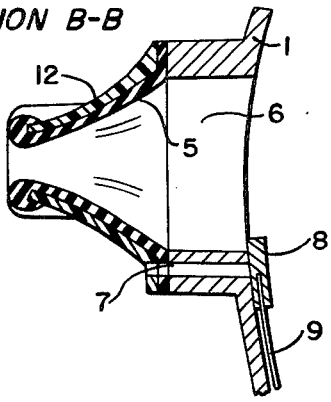
FIG. 5 is a fragmentary section on the line B—B of FIG. 6 showing the resilient outlet conduit in an open position.
Figure 6:
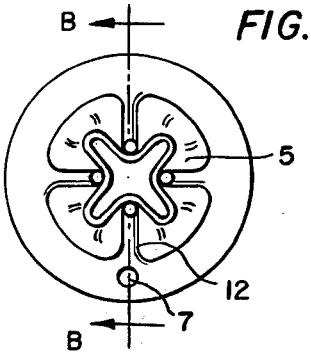
FIG. 6 is a front elevation of the resilient outlet conduit shown in FIG. 5.
Figure 7:
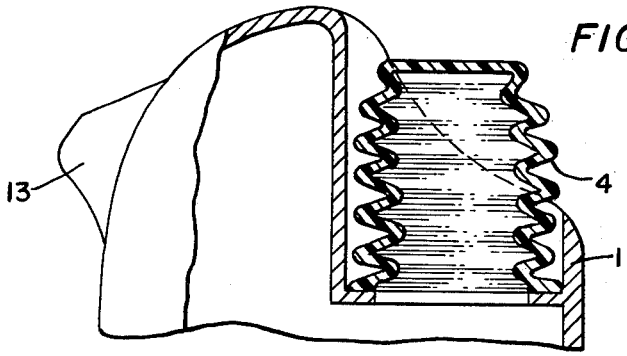
FIG. 7 shows a fragmentary section of the deformable resilient region of the dispenser which, in this modification, is a cylinder the walls of which are folded bellows-fashion and which, on being brought together, are capable of reducing the inside volume of the hollow body.
Figure 8:
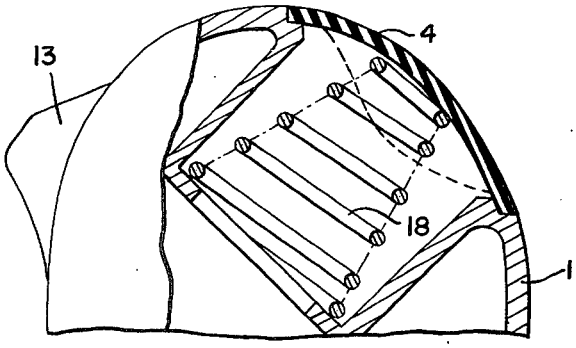
FIGS. 8 and 9 are fragmentary sections showing the resilient region of the hollow body wall which, in this modification, is concave in a rest position as seen in FIG. 8 and convex at maximum deformation, as seen in FIG. 9; together with the auxiliary resilient element, which in this case comprises a conical spring.
Figure 9:
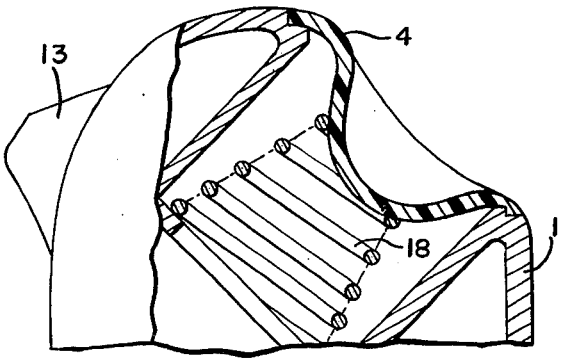
Figure 10:
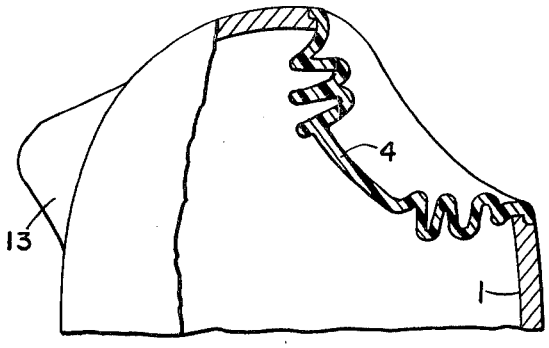
FIGS. 10 and 11 are fragmentary sections illustrating the resilient region, which in this modification is provided with a generally conically shaped folded-wall capable of deformation due to stretching of the folds therein, thus bringing about the diminution of the inner volume of the hollow body.
Figure 11:
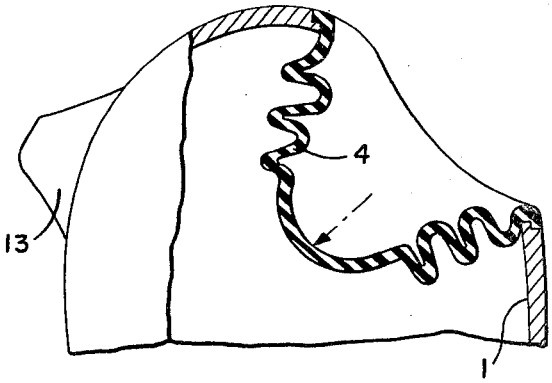
Figure 12:
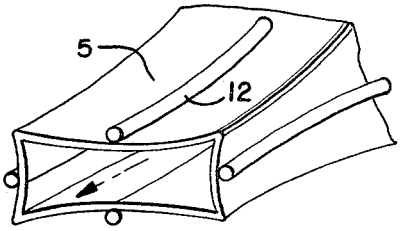
FIGS. 12 and 13 show the resilient conduit being of rectangular cross-section and in its positions of maximum open and closed positions.
Figure 13:
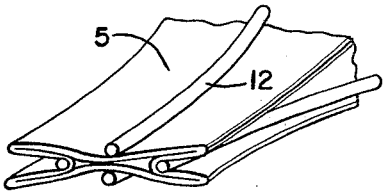
Figure 14:
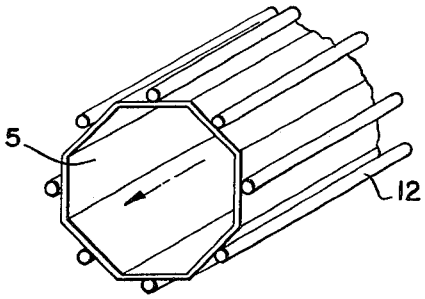
FIGS. 14 and 15 show the resilient conduit in another of its possible structural modifications which is, in this case a polygonal cross-section, and also show the conduit in its maximum open and closed positions.
Figure 15:
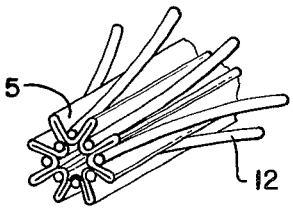

In accordance with FIG. 1, the present invention is applied to a salad oil container, consisting of a receptacle portion (3) connected at its upper part to a cover (1), which is threaded thereto. A seal 10 assures the hermetic closure of the threaded connection between the receptacle and cover. The cover (1) is provided with an outlet orifice (6) having a perimetral shoulder (11) to which the end of the resilient conduit (5) is integrally affixed. The walls of said conduit are provided with resilient beads (12) which are integrally joined at one end thereof to the shoulder (11) and lie above the folds of the resilient conduit (5) at the free end of said conduit. The collecting nozzle (13) totally surrounds the resilient conduit (5), defining between them, a space (14) the purpose of which is to store the liquid dripping from the free end of the resilient conduit (5). An orifice (7) connects the lowest point of the space (14) with the inside of the receptacle 3, said orifice being closed from inside the receptacle by valve means comprising a pad (8) integrally joined to a spring arm (9) which, in its rest position, biases said pad against the orifice to seal the same. A sector of the cover 1 opposite to the outlet orifice 6 of cover (1) is provided with a circular orifice (15) which, at the perimeter thereof, is furnished with two steps (16) and (17). Step (17) serves to support a conical spring (18) which is covered by a deformable resilient membrane (4), in turn joined along its entire perimeter integrally to step (16) and guaranteeing a hermetic closure of the receptacle.

The operation and use of the improved dispenser, according to the present invention, is effected in a very simple manner, as will be seen from the following description:

Once the liquid to be dispensed has been placed within the receptacle (3), the receptacle is closed hermetically with cover (1) which, in this case, is threaded but which optionally can be mounted in any other manner joining it solidly to the receptacle (3). To operate the dispenser, it is taken with one hand and turned over in order that the product to be dispensed may face the outlet orifice 6. With the index finger, pressure is then exerted on the resilient region (4), thus causing a pressure increase inside the receptacle, i.e., the air on being compressed will transmit said pressure to the liquid mass and the latter, being in a position ready for use, will be covering the outlet orifice (6) and will consequently be expelled outwardly, the thickness of the liquid stream depending upon the width of separation of the walls of the resilient conduit (5). This thickness will in turn vary as a function of the internal pressure and, consequently, the flow can be controlled at will and any variation in the pressure applied to the resilient region (4) will be transmitted into a variation of the cross-section of the liquid stream. This is of fundamental importance inasmuch as, if the outlet velocity of the liquid were to increase excessively, splashing or similar inconveniences could occur.

If the dispenser is not in a position ready for use and pressure were exerted on the resilient region (4) only air will be expelled through the resilient conduit (5). Once the liquid has been expended in the desired quantity pressure is withdrawn from the resilient region (4) which then, due to the effect of spring (18), will return to its rest position, thus creating a decrease of pressure within the receptacle, said decrease of pressure producing the instantaneous blocking of the passage of the resilient conduit (5). This conduit will then be closed at its free end due to the combined action of the resiliency of its walls, the effect of the resilient beads (12) and the difference in pressure between the inside and the outside of the receptacle. Consequently, the air pressure will move the valve pad (8) to an open position and will force the portion of oil resulting from spillage from the collecting nozzle 13 of the resilient conduit (5) back into the receptacle portion 3 of the container through the orifice 7. Once internal pressure has been restablished, pad (8) will again close the conduit (7) due to the spring action of arm (9). During the entire process just described, the resilient conduit (5) has remained totally closed.

Obviously, a small decrease in pressure in the container relative to the atmospheric pressure will remain inside the receptacle as a consequence of the spring arm (9). This residual depression will serve to retain the tightness of the inside faces of the folds of the resilient conduit (5), the latter effect being aided by the liquid element which may have remained on said faces and which collaborates in sealing said closure.

It is evident that various changes in structure and detail may be introduced without thereby departing from the scope of the present invention.

I claim:

1. A container for dispensing liquids in an intermittent manner comprising in combination, a lower hollow body containing the liquid, a cover threaded onto said body and including a wall portion of resiliently deformable material and deformable towards the inside of said body, said cover provided with an upper and a lower orifice separated from one another and located at different levels, a conduit of resiliently deformable material including inlet and outlet ends, the inlet end of said conduit affixed to said cover and surrounding said upper orifice, the outlet end of said conduit projecting outwardly from the cover to provide a spout for the liquid being dispensed, said outlet end of the conduit normally being in a closed position, said conduit being opened to discharge liquid in response to pressure from inside the container produced by manual pressure against said resiliently deformable wall portion of the cover, a nozzle surrounding at least part of said conduit and defining a space for collecting liquid dripping from the outlet end of the conduit after discharge of liquid therefrom, said lower orifice located in the bottom of said space between said nozzle and conduit and connecting said space with the inside of the container, a valve member inside of said container for covering and uncovering said lower orifice, said valve member comprising a spring arm connected at one end to the inner surface of the container, the other end of said spring arm being free, a pad mounted on said free end, said spring arm normally urging said pad to cover said lower orifice whereby outside pressure greater than the pressure inside the container causes said pad to uncover said orifice, to thus permit the passage of liquid collected in said space together with ambient air into the interior of the container.

2. A container according to claim 1, wherein said conduit of resiliently deformable material is of substantially rectangular cross-section and a resilient member, affixed to said cover, is supported on each of the faces of said conduit, said resilient members forming a pair of opposed folds in said conduit and a pair of engaging lips to close the outlet of the said conduit.

3. A container according to claim 1, wherein said conduit of resiliently deformable material is of polygonal cross-section defining a plurality of faces, resilient members bearing on said faces and affixed to said cover in supporting relation therewith and forming a plurality of folds in said conduit for closing the outlet thereof.

4. A container according to claim 1, wherein the free edge of said resiliently deformable wall portion is fixed in a recess surrounding an orifice provided in said cover.

5. A container according to claim 4, wherein said resiliently deformable wall section is of convex shape in the undeformed condition.

6. A container according to claim 4, wherein said resiliently deformable wall section is of generally concave shape in both its undeformed and deformed condition.

7. A container according to claim 6, wherein said resiliently deformable wall portion comprises a membrane having a series of folds extending towards the interior of the container.

8. A container according to claim 4, including a spring, the upper end of which abuts the inner surface of said resiliently deformable wall section, the lower end of said spring seated in a recess in said cover.

* * * * *